US010750862B2

(12) United States Patent
Rihtarec et al.

(10) Patent No.: US 10,750,862 B2
(45) Date of Patent: Aug. 25, 2020

(54) GUIDE RAIL OF A GUIDANCE SYSTEM, GUIDANCE SYSTEM, METHOD FOR PRODUCING A GUIDE RAIL AND FURNITURE

(71) Applicant: Grass GmbH, Hoechst (AT)

(72) Inventors: Filip Rihtarec, Fussach (AT); Gabriel Auer, Maeder (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 16/207,724

(22) Filed: Dec. 3, 2018

(65) Prior Publication Data

US 2019/0167001 A1 Jun. 6, 2019

(30) Foreign Application Priority Data

Dec. 4, 2017 (DE) ..... 10 2017 128 745

(51) Int. Cl.

| | |
|---|---|
| ***A47B 88/00*** | (2017.01) |
| ***A47B 88/49*** | (2017.01) |
| ***B21D 5/14*** | (2006.01) |
| ***A47B 88/477*** | (2017.01) |
| ***B21D 53/38*** | (2006.01) |

(Continued)

(52) U.S. Cl.

CPC ..... *A47B 88/49* (2017.01); *A47B 88/463* (2017.01); *A47B 88/467* (2017.01); *A47B 88/477* (2017.01); *A47B 88/493* (2017.01); *B21D 5/14* (2013.01); *B21D 47/01* (2013.01); *B21D 53/38* (2013.01); *B21D 5/08* (2013.01)

(58) Field of Classification Search

CPC ..... A47B 88/49; A47B 88/493; A47B 2210/0056; A47B 2210/0059

USPC ..... 312/334.6, 334, 45

See application file for complete search history.

(56) References Cited

U.S. PATENT DOCUMENTS 4,549,665 A * 10/1985 Smitley ..... A47B 57/22 211/191

4,752,143 A * 6/1988 Lautenschlager, Jr. ..... A47B 88/487 384/19

(Continued)

FOREIGN PATENT DOCUMENTS

| | | |
|---|---|---|
| DE | 36 23 743 A1 | 1/1988 |
| DE | 199 31 842 A1 | 1/2001 |
| DE | 102 28 670 A1 | 1/2004 |

OTHER PUBLICATIONS

German Search Report (Application No. 10 2017 128 745.0) dated Oct. 17, 2018.

*Primary Examiner* — Matthew W Ing

(74) *Attorney, Agent, or Firm* — Burr & Brown, PLLC

(57) ABSTRACT

A guide rail of a guidance system for a push element is provided. The guide rail is formed as a hollow profile enclosed by wall sections of the guide rail. The wall sections comprise a horizontal wall section and two side wall sections. The horizontal wall sections extend parallel and perpendicular to a lengthwise extension of the guide rail, and the side wall section extends parallel and perpendicular to the lengthwise extension of the guide rail. The side wall sections are oriented at an angle to the horizontal wall sections. The horizontal wall sections and the two side wall sections, in a cross section perpendicular to a lengthwise extension of the guide rail, form at least for a portion the three side lines of a triangle, wherein the horizontal wall section defines a distal wall of the hollow profile.

20 Claims, 5 Drawing Sheets

(51) Int. Cl.

| | |
|---|---|
| ***A47B 88/493*** | (2017.01) |
| ***B21D 47/01*** | (2006.01) |
| ***A47B 88/463*** | (2017.01) |
| ***A47B 88/467*** | (2017.01) |
| *B21D 5/08* | (2006.01) |

(56) References Cited

U.S. PATENT DOCUMENTS

| | | | | |
|---|---|---|---|---|
| 6,347,849 | B1 | 2/2002 | Müterthies et al. | |
| 2004/0007953 | A1 | 1/2004 | Muller | |
| 2006/0273705 | A1* | 12/2006 | Yeh | A47B 88/493<br>312/334.31 |
| 2010/0163506 | A1* | 7/2010 | Clarke | A47B 47/027<br>211/183 |
| 2013/0336602 | A1* | 12/2013 | Jahrling | F24C 15/168<br>384/49 |

* cited by examiner

GUIDE RAIL OF A GUIDANCE SYSTEM, GUIDANCE SYSTEM, METHOD FOR PRODUCING A GUIDE RAIL AND FURNITURE

This application claims the benefit under 35 USC § 119(a)-(d) of German Application No. 10 2017 128 745.0 filed Dec. 4, 2017, the entirety of which is incorporated herein by reference.

FIELD OF THE INVENTION

The present invention relates to a guide rail of a guidance system, a guidance system, a method for producing a guide rail, and furniture.

BACKGROUND OF THE INVENTION

Guide rails and guidance systems for a push element, especially a push element of furniture or a household appliance such as e.g. a kitchen appliance, are known in various designs.

For example, so-called partial extensions with two guide rails or full extensions with three guide rails are in use for a pull-out component, where the rails can be moved telescopically in relation to each other.

Generally a push element such as a drawer, a shelf, a cooking product carrier or the like is movably received by precisely two separate but identical components of a partial extension or a full extension. The respective component of the extension guides is preferably secured to an inner side of a furniture body or a housing of a household or kitchen appliance.

Since a guidance system or a guide rail must stand up to high technical and economical demands, further optimizations in this regard are necessary.

SUMMARY OF THE INVENTION

The problem which the present invention proposes to solve is to further improve the aforementioned guides and their provision as well as the corresponding furniture and household or kitchen appliances, especially in terms of a relatively high mechanical loading capacity of the guide and its economical manufacture.

In particular, material-saving and highly stable extension guides should be provided, being especially space-saving and advantageous in their design, and furthermore withstanding high static and dynamic loads.

The present invention starts at first from a guide rail of a guidance system for a push element, especially for a push element of furniture or a household appliance such as e.g. a kitchen appliance, wherein the guide rail is formed as a hollow profile enclosed by wall sections of the guide rail, the wall sections comprising a horizontal wall section and two side wall sections, wherein the horizontal wall section extends parallel and perpendicular to a lengthwise extension of the guide rail, and the side wall section extends parallel and perpendicular to the lengthwise extension of the guide rail, wherein the side wall sections are oriented at an angle to the horizontal wall section. By parallel and perpendicular is meant the orientation of the plane of respective flat principal sides of the horizontal wall section and the side wall sections. The side wall sections stand off at an angle on the same side relative to the horizontal wall section. The guide rail, in particular, consists of a thin sheet metal material bent into the final shape.

The present invention relates, in particular, to a furniture guide rail or rails of a furniture partial extension or furniture full extension or a household appliance guide rail.

The crux of the present invention lies in the fact that the horizontal wall section and the two side wall sections in a cross section perpendicular to a lengthwise extension of the guide rail form at least for a portion the three side lines of a triangle, wherein the horizontal wall section defines a distal wall of the hollow profile.

Accordingly, the sections are each configured as a straight line in cross section. One corner region or two or all three corner regions of the fundamental or imaginary triangle when viewed in the cross section may deviate from the geometrically defined corner shape of the corresponding triangle. The corner regions which are respectively formed by two converging wall sections in the cross section may touch in a corner or converge straight to the corner. The corner regions of the fundamental triangle are preferably configured differently for the hollow profile and/or there may be present a material-free gap between the ends of two respective converging wall sections. A straight segment of a wall section may also be longer than a side line of the respective triangle.

The horizontal wall section and the two side wall sections are arranged, e.g., in a triangle shape. In this way, the guide rail can be provided with a relatively slight material input in terms of the manufacturing process. Furthermore, comparatively high stability values can be achieved with the guide rail according to the present invention.

In particular, the guide rail according to the present invention has high mechanical stability. In particular, the guide rail according to the present invention is stable to bending in lengthwise extension or in the direction of the longitudinal axis and relatively stable to a deformation by twisting or due to torsion about the longitudinal axis.

The guide rail with its at least approximately triangle shape in the basic form in cross section is accordingly triangle shaped in the basic form with corner regions preferably not acutely angled on the outside. The corner regions may have protruding segments on the outside, for example. The corner regions which are formed between the horizontal wall section and the respective side wall section and in the region where the two side wall sections converge or are adjacent to each other preferably have segments with convex shape or with a rounded outer contour. The corner regions between the horizontal wall section and the respective side wall section or its outer contour segments are preferably loop shaped, for example.

The hollow profile is preferably configured as a hollow profile closed at the circumference for at least a substantial part of its length, for example, in the form of a tube closed lengthwise and approximately triangular in cross section or a tube closed lengthwise and having an outer triangular shape.

Preferably, an interior angle is formed between the horizontal wall section and a side wall section between 30 angular degrees and 70 angular degrees. Preferably both side wall sections are angled on the horizontal wall section with the same interior angle. The three corner regions of the triangle shape of the hollow profile accordingly lie in the region of the respective connection section between the horizontal wall section and the respective side wall section and the region in which the two converging ends of the two side wall sections approach each other. This corner region of triangular shape dictated by the two side wall sections lies on an opposite side, when viewed from the horizontal wall section, in regard to the center of the triangular hollow profile. Preferably, the corner region dictated by the two side wall sections is situated on the normal to the horizontal wall section, intersecting the center line separating the horizontal wall sections into two equally broad strips in its lengthwise extension.

The horizontal wall section and thus one outer side of the horizontal wall section are at least substantially horizontally oriented in the condition of use of the guide rail, when the guide rail is installed in the finished guidance system. The horizontal wall section, preferably shaped as a strip in its basic form, extends by its two preferably parallel lengthwise edges in the lengthwise extension or lengthwise direction of the guide rail. The horizontal wall section is subtended between two end-side edges or front-side transverse edges oriented transversely to the lengthwise edges and in the lengthwise extension of the horizontal wall section and the two lengthwise edges of the horizontal wall section. The horizontal wall section has an outer side, whose surface is preferably flat and level. Spaced apart from the outer side by the material or sheet metal thickness and situated opposite it is an inner side of the horizontal wall section bounding the cavity of the hollow profile. The horizontal wall section may form a bottom or a top side of the guide rail in relation to a condition of use.

The two side wall sections adjoin each other in the region along the two lengthwise edges. In the region of a first lengthwise edge of the horizontal wall section, a first side wall section adjoins it directly or preferably across a connection section angled with respect to the horizontal wall section. In the region of a second lengthwise edge of the horizontal wall section, a second side wall section adjoins it directly or across another connection section angled with respect to the horizontal wall section. Preferably the first and the second side wall section are each present in the same fashion on the horizontal wall section or angled at the same angle with respect to the plane subtended by the horizontal wall section. Preferably, in each case a side wall section is formed adjacent to a horizontal wall section along its two lengthwise sides. Preferably, the horizontal wall section and the two side wall sections have at least approximately the same length and are formed preferably over the entire length of the guide rail.

Each side wall section is preferably made from the same material as the horizontal segment or is formed as a single piece with it. Accordingly, the horizontal wall section and the first and the second preferably strip-shaped side wall section are made from a thin material layer, preferably a metal sheet 0.5 to over 2 millimeters in thickness, preferably a metal sheet between 0.8 to 1.2 millimeters thick. The sheet metal thickness of the guide rail is preferably uniform and identical throughout.

The rail guidance system formed with the guide rail is configured, in particular, as linear guides. In the case of a partial extension, a structural unit of the guidance system comprises a body rail attachable on the body side in a fixed position in the condition of use and a movement rail or running rail which can move relative to the body rail in the condition of use, being also called hereafter the push element rail.

In the case of the rail guidance system formed as a full extension, there are present a body rail and a push element rail and a center rail arranged between the body rail and the push element rail. Usually, furthermore, sliding and/or roller bearing means are present for the relative displaceable movement of the rails of a structural unit. The bearing means operating between the rails comprise, for example, a carriage with a bearing body or preferably a plurality of bearing bodies received therein, such as roller bearing bodies.

The hollow profile is to be understood as a profile enclosing a cavity substantially at least circumferentially to the longitudinal axis with wall sections of the profile, such as the horizontal wall section and the side wall sections and possibly further wall sections. The cavity is preferably a hollow volume free of material, extending outwardly or in the radial direction to a central longitudinal axis of the guide rail, centrally in the hollow volume, and bounded by the wall sections. The hollow profile is preferably open at the end face.

Furthermore, running or supporting surfaces for the mounting of further components of the guidance system, especially for a further guide rail and/or bearing body of the bearing means of the guidance system, are provided on the guide rail according to the present invention, being oriented to a spatially advantageous narrow space or compact manner.

For example, the cavity has approximately a rod shape with a triangular cross section in the basic form.

The horizontal wall section and the two side wall sections may form the guide rail by themselves or form, for example, an upper part region and/or a lower part region of a guide rail. If in addition to the triangular part region of the guide rail there is present a further part region in a non-triangular basic form, which is especially advantageous in the case of a full extension guidance system, the further upper or lower part region may likewise be configured as a profile, preferably as a hollow profile, such as a rectangular profile, an L-profile or a T-profile.

Preferably in the case of a full extension guidance system the guide rail has an upper part region and a lower part region, where the upper and the lower part region each have a horizontal wall section and two side wall sections according to the present invention, being arranged in a cross section perpendicular to a lengthwise extension of the hollow profile in a triangular shape, with the horizontal wall section defining a distal wall of the hollow profile.

In a vertical direction with respect to the orientation of the guide rail in its condition of use, there may be formed an intermediate region between the upper and the lower part region of the guidance system, for example, by further wall sections of the guidance system oriented at an angle to the horizontal wall section or side wall section and spaced apart in the width direction or transversely to the height. Alternatively, no intermediate region may be present between the upper and the lower part region. For example, the upper and the lower part region may be joined together directly, preferably each being triangular in cross section in the basic shape. Preferably the guide rail is formed symmetrically, e.g., with axial and/or mirror symmetry, as shall be explained further below.

Preferably the horizontal wall section and the two side wall sections are formed as a single piece or they are placed in the final form of the guide rail by a forming process such as a cold forming, during the manufacturing from a cohesive flat material.

A distal wall of the hollow profile formed by the horizontal wall section means that the wall section of the guide rail which is formed by the horizontal wall section has an outwardly directed outer side, forming a surface side which is furthest on the outside from the center of the guide rail in the respective direction. Optionally, narrow or small regions may exist on the guide rail at the side along the horizontal wall section, lying further outward from the center than the flat outer side of the horizontal wall section. One such region is, in particular, a connection section, which is formed, for example, by the transition present between the lengthwise edge of the horizontal wall section and the respective side wall sections. The connection section, for example, may have a curved material segment situated further from the center of the guide rail in the respective direction, or upward or downward, than the horizontal wall section or its outer side.

Basically, the foregoing remarks apply regardless of whether the outer side of the horizontal segment forms a top side or a bottom side of the guide rail in the condition of use.

It is also of advantage for the wall sections to comprise a connection section, wherein the horizontal wall section and the side wall section are joined across the connection section, wherein the connection section comprises a support section and a bend section which is angled on the support section, in particular, bent in a curve, and wherein the bend section is angled or bent around so much toward the support section that the bend section and the support section subtend a bend angle in a range between 45 angular degrees and 180 angular degrees.

In this way, the guide rail according to the present invention can be fabricated advantageously, especially with the aid of an automated or machine-based bending process from a flat material, such as a sheet metal strip. Accordingly, the side wall sections and the horizontal wall section are present as a single piece. In particular, precisely two side wall sections are present, bent into a curve, on the horizontal wall section, each one adjoining the two lengthwise side edges of the horizontal wall section across a connection section.

The connection section comprises the support section and the bend section. The connection section has one or more bends or back folds and is preferably hoop or ear or groove shaped in cross section to the length of the guide rail with a bent, straight, or funnel shaped segment of the contour, such as U-shaped, V-shaped, and/or polygon shaped.

Preferably the bend section adjoins the horizontal wall section via a first bending site. The bend section reaches e.g. as far as a second bend, where a first edge of the support section adjoins it. The support section passes into the side wall section at a second edge with a further bend or the support section extends straight or without a bend into the side wall section. The connection section is approximately loop or ear shaped in cross section. The connection section, in particular, protrudes somewhat beyond the horizontal wall section or its outer side. Preferably, the respective connection section is formed identically on the horizontal wall section along both lengthwise edges.

The triangle shape describes an approximate basic form of the guide rail according to the present invention, with which various embodiments of the connection section between the horizontal segment and the respective side wall section are possible. The connection section is preferably produced by a cold forming process, especially during the performing of a bending and/or folding back work step.

Advantageously, the connection section is formed over at least the majority of the length of the horizontal wall section along its lengthwise side or longitudinally as a bulge.

However, a direct connection is also conceivable between the horizontal wall section and the side wall section with no intermediate section. Preferably both side wall sections are connected in the same or identical manner to the common horizontal wall section.

As already mentioned, the connection section may protrude outwardly or distally at least partly beyond the horizontal wall section or the plane of the outer side of the horizontal wall section. Conversely, the top side of the guide rail or the outer side of the horizontal wall section may be somewhat depressed along the normal to the horizontal wall section as compared to a tallest location of the connection section or one which is the furthest removed from the guide rail center.

The connection section extends preferably over the entire length of the horizontal wall section or the guide rail, especially on both sides along the lengthwise edges of the horizontal wall section. Only brief interruptions may be bent off from the connection section as end stops.

It is also of advantage for the horizontal wall section to form a top side and/or a bottom side of the hollow profile. This establishes an orientation of the guide rail in the condition of use or the installed condition of the guidance system on furniture or on a household appliance such as a kitchen appliance.

The spatial orientation of the guide rail in the condition of use is such that a guide rail top side or a guide rail bottom side is formed with the horizontal wall section. If the horizontal wall section in the condition of use of the guide rail is present in the height direction above the respective side wall sections projecting downward from it, then the horizontal wall section forms the top side of the hollow profile. If the horizontal wall section in the condition of use of the guide rail is present in the height direction below the respective side wall sections projecting upward from it, then the horizontal wall section forms the bottom side of the hollow profile.

For the forming of a top side and a bottom side of the guide rail by a respective separate horizontal wall section, the guide rail or the hollow profile comprises two part regions, each of them formed triangular in cross section from a horizontal wall section and two adjacent side wall sections angled on it. The cross section of this hollow profile has approximately the contour of an hourglass or is dumbbell shaped with a central constricted area and two end-side regions enlarged in the height direction. The constricted area looking in the cross section of the guide rail is formed at least partially by the side wall sections converging on each other toward the center of the guide rail on a common horizontal wall section, with or without an intermediate region adjoining the side wall sections, which joins the two side wall sections of the upper horizontal wall section to the two side wall sections of the lower horizontal wall section. It is also conceivable to have no intermediate region, and then the converging ends of the two upper side wall sections are joined directly to the converging ends of the two lower side wall sections.

The respective horizontal wall section has an outwardly directed flat and level outer side, which in the installed condition is oriented horizontally in particular. In the case of two horizontal wall sections, forming the top side and the bottom side, the top side and the bottom side are oriented in parallel, and their outer sides are vertically spaced apart from each other by distance forming essentially the entire height of the guide rail, apart from optional minor additional heights due to the connection sections, which together make up e.g. around 5% of the overall height.

Another advantageous modification of the present invention is characterized in that the connection section is designed such that one side of the bend section comes to bear against the support section. This is an especially advantageous configuration in terms of production technology and from mechanical viewpoints. In particular, the bearing produces a mutual supporting of the bend section and the support section. In this way, an interior side of the bend section comes to bear against an interior side of the support section. Furthermore, the bearing realizes a material thickening or an increased material thickness in the connection section and thus further mechanical stability, since a first material layer is provided by the bend section and a second material layer by the support section, and therefore a double layer exists in this segment. The connection section accordingly has preferably bent material regions, such as bent sheet metal segments of the originally flat sheet metal material.

With the bend section and the support section the guide rail is stabilized, in particular, against an elastic deformation. For example, forces acting on the bend section can be absorbed by the support section and vice versa. The forces arise, for example, when the horizontal wall section and the side wall sections are loaded by the weight of the push element or the load placed on it during use of the guidance system. The increased stability on the guide rail acts advantageously in various spatial directions, for example, against a deformation due to bending and/or torsion with respect to the guide rail longitudinal axis.

It is also advantageous for the guide rail to be formed from a formed flat material. The flat material is, in particular, a strip material or strip shaped, preferably made from a steel or sheet metal material. The guide rail, in particular, is preferably entirely formed from a sheet metal material, preferably by a cold forming process from a stamped out flat material.

It is also advantageous for the hollow profile to be present in mirror symmetry in two mirror planes in a cross section, the two mirror planes standing perpendicular to each other. In particular, the mirror planes intersect in the central longitudinal axis of the guide rail. A weld seam of the guide rail which is optionally present along one side of the guide rail may mean a slight departure from the absolute mirror symmetry on one of the two mirror planes, which in practice is of no significance as regards the possibility of variable use regardless of the direction or side. For example, the weld seam is present for the length of the guide rail on one side of the guide rail, especially in the region of the intermediate section, but not on the opposite side in the width direction. This is justified in that the guide rail is preferably made from a flat material, whose opposite lengthwise edges are welded together in the finished guide rail.

Thanks to the mirror symmetry, the guide rail may be used optionally for a right or a left guidance system on a push element. Moreover, each end of the two ends of the guide rail may form a front or optionally a rear end of the guidance system, in relation to the condition of use. In other words, the guide rail given an assumed horizontal lengthwise orientation may be used identically each time, respectively rotated by 180 angular degrees to the horizontal, just as an identical usage is possible respectively rotated by 180 angular degrees to the vertical.

In the region of a weld seam of the finished hollow profile, prior to the welding together of the material regions to be joined by welding, the material thickness of these material regions is reduced preferably by rolling, e.g., with rollers, to preferably 50 percent of the thickness of the remaining material regions, preferably to a reduced material thickness of around 0.3 to 0.5 millimeters or to around 0.4 millimeters.

Another advantageous modification of the present invention is characterized in that the wall sections comprise a vertical wall section, wherein the vertical wall section joins side wall sections to each other. The vertical wall section thus belongs to the above discussed intermediate section.

When the guide rail comprises a first or upper rail region with a horizontal wall section and two angled side wall sections and in addition comprises a second or lower rail region with a horizontal wall section and two angled side wall sections, then a first vertical wall section connects one end of an upper side wall section to one end of an opposite lower side wall section in the height direction. In the condition of use, the vertical wall section is preferably oriented perpendicular.

It is especially advantageous when a further vertical wall section is present on the other side of the guide rail, connecting one end of the other upper side wall section to one end of the other lower side wall section. Preferably the wall sections are formed such that the mirror symmetry exists about two perpendicular mirror planes also in this configuration.

Advantageously, the guide rail comprises two oppositely situated horizontal wall sections with respectively two side wall sections, the two vertical wall sections being present in a middle part constricted or curtailed on both sides.

According to another advantage of the present invention, the support section is oriented parallel to a side wall section. For example, a slight offset is present between the support section and the side wall section. Preferably no offset is present, so that the support section forms a continuous lengthening of one side wall section, at an end segment of the side wall section oriented toward the horizontal wall section.

One advantageous variant of the subject matter of the present invention is characterized in that the bend section is oriented parallel to a side wall section, in particular, parallel to a support section. Advantageously, the bend section lies by its inner or bottom side flat against the support section or its inner side, so that the bend section and the side wall section are parallel.

Preferably the horizontal segment and the bend section make an angle greater than 90 angular degrees, preferably an angle of around 130 to 150 angular degrees, preferably 140 angular degrees.

It is also advantageous for the hollow profile to comprise an end stop element acting in the lengthwise direction of the hollow profile in the region of the connection section. The end stop element is formed, in particular, by a partly cut-away and bent back segment in the connection section, wherein the end stop element protrudes beyond the contour of the remaining guide rail. The end stop element serves, in particular, as a boundary for a lengthwise movement of the carriage of the bearing means.

Furthermore, it is advantageous for the horizontal wall section and/or the side wall section to form a contact surface for portions of the bearing assembly in each case at least for a part length of the guide rail.

Advantageously, the respective outwardly pointing flat or level outer sides of the horizontal wall section and the side wall sections form a running surface for respectively corresponding roller bearing bodies running or rolling on the corresponding outer side. The running direction is in the lengthwise direction of the guide rail. Each time preferably a plurality of cylindrical rolling bodies received on a carriage roll on the horizontal outer side of the horizontal wall section in the condition of use, i.e., in the case of two horizontal wall sections, on a horizontal top side and a horizontal bottom side of the guide rail. The bearing forces, acting substantially in the vertical direction, are absorbed in this way.

Likewise preferably a plurality of cylindrical roller bearing bodies of the carriage roll against the slanted flat outer sides of the side wall sections, which besides transmitting the bearing forces transversely to the running direction also play a sideways horizontal guiding role and a vertical guiding role.

Furthermore, the present invention is addressed to a guidance system for a push element, especially a linear guidance system for a push element of furniture or a household appliance such as, for example, a kitchen appliance, wherein the guidance system comprises a structural unit with precisely two guide rails, the guide rails comprising a body rail and a push element rail movably received on the body rail, wherein the push element rail is designed for a connection to the push element, wherein a carriage is provided between segments of the body rail and the push element rail for a relative movement between body rail and push element rail, the significant aspect of the present invention being that the body rail is designed as a guide rail according to one of the embodiments described above. Preferably the body rail is configured as a triangular hollow profile which is closed in cross section in the basic form. The push element rail is preferably configured as a profile open at the bottom, enclosing the triangular shape from the top. Preferably at least one interior part region of the push element rail is approximately triangular in shape, which is advantageous for a compact or nested design of the rails, whereby the corresponding carriage interacts with bearing bodies in a narrow gap between the rails.

In this way, an especially stable partial extension guidance system is provided, being very bending-stable and torsion-stable with comparatively slight material input. A bearing assembly acting between the rails preferably comprises at least one carriage with a plurality of bearing bodies received on it, which run or roll along the horizontal wall section and along both side wall sections during the operation of the partial extension.

Furthermore, the present invention is addressed to a guidance system for a push element, especially a linear guidance system for a push element of furniture or a household appliance such as, for example, a kitchen appliance, wherein the guidance system comprises a structural unit with precisely three guide rails, the guide rails comprising a body rail, a push element rail and a center rail, wherein the push element rail is designed for a connection to the push element, wherein the center rail is present between the body rail and the push element rail, wherein for a relative movement between the rails there is provided a carriage between segments of the body rail and the center rail and there is provided a carriage between segments of the center rail and the push element rail, wherein the center rail is designed as a guide rail according to one of the above described embodiments or is configured as a triangular hollow profile which is closed in cross section in the basic form.

In the case of a full extension guidance system or a so-called full extension, the guidance system is preferably designed as a subfloor guidance system. The push element rail is designed such that a bottom side of a bottom of the push element can be braced against the push element rail in the attached condition of use of the guidance system. Accordingly, the drawer bottom is placed on the push element rail from above.

The full extension and the partial extension may also alternatively be designed for placement, for example, in a cavity of a hollow chamber frame.

Finally, the present invention also extends to a method for manufacturing a guide rail according to one of the aforementioned arrangements, wherein the guide rail is fabricated from a flat material, especially a strip material, wherein the manufacturing of the guide rail is done by a continuous forming process of the flat or strip material. The starting material for the manufacturing is preferably a flat sheet metal or a comparatively easily cold workable steel material.

Advantageously, the continuous forming process of the flat or strip material is done by a continuous roll forming process. The manufacturing methods are divided into six different processes, for example, according to DIN 8580, of which besides joining in particular forming by pressure forming, such as continuous roll forming methods, in particular, is suitable for the manufacturing of the guide rail.

In this case, the strip material is transported continuously along a machining path and undergoes a plurality of continuous or sequential machining steps, such as a forming by pressure elements, such as pressure rollers. The pressure rollers exert pressure forces which can be defined in advance, to a predetermined degree and at predetermined locations. The material gradually undergoes plastic deformation in a defined manner until it reaches its end shape.

Furthermore, other manufacturing methods can be used in the manufacturing of the guide rail, sometimes hand in hand with continuous roll forming or in prior or subsequent work steps, especially bending forming. It is advantageous during the fabrication of the guide rail for a strengthening to occur at least in part regions of the sheet metal material along with the forming of the sheet metal material, which brings about an advantageous change in the material properties.

Advantageously, a welded connection between segments of the formed flat or strip material is made by a continuous laser welding process in a work step following the continuous forming process of the flat or strip material. In the continuous laser welding process along a linear welding line for the length of the shaped hollow profile, it is advantageous to achieve an equally high or optimized welded connection quality over the entire weld seam, since according to the present invention the continuous process eliminates the run-in and run-out zone of the laser welding unit such as occur, e.g., in a discontinuous or timed manufacturing process, which would result in correspondingly diminished weld quality.

Further, one advantage of the present invention is achieved if the welding between segments of the formed flat material is done such that the material thickness in the region of the material being welded is reduced as compared to the remaining regions of the formed flat or strip material.

If the guide rail is formed from a flat strip-shaped sheet metal material by forming, which is preferred, the hollow profile will have at least one length or line region along which the lengthwise edges of the formed sheet metal material extend. On the formed product, the lengthwise edges are preferably formed toward each other and therefore are close together or in contact with each other, which has a mechanically stabilizing effect. Preferably, the two lengthwise edges of the sheet metal material abut against each other in blunt manner on the formed hollow profile, preferably being materially bonded or welded together.

The hollow profile and the wall sections of the hollow profile are accordingly preferably without a separation site or without open seam with a gap free of material in the lengthwise extension of the hollow profile. A gap width can be minimal, or even disappear, which is realized by a bearing contact of the edges on other segments of the hollow profile or preferably with a mutual bearing contact, for example, by blunt abutment of the narrow end faces of the edges.

The edges of the formed sheet metal material are braced against each other or are pressed against each other on the hollow profile and have a physical contact and preferably a materially bonded connection. The mutual contact of the edges is preferably present over the entire length of the hollow profile.

Preferably the lengthwise edges are joined to each other or to other segments of the guide rail along the entire length, being preferably materially bonded, e.g., thermally joined or welded. Preferably the blunt abutting edges are welded to each other over at least the majority of the length of the edges.

Neither is it ruled out for regions of the edges to be joined together, in particular, and other regions to not be connected, e.g., materially bonded, along the adjacent edges. For example, the edges are welded together at multiple spots spaced apart from each other, whereas other locations are not welded or materially bonded, but instead are in mutual bearing contact, in particular.

Preferably, the welding between segments of the formed flat material is done such that the material thickness in the region of the material being welded is reduced as compared to the remaining regions of the formed flat or strip material. In this way, less energy is needed for welding during the laser welding as compared to welding with no reduced material thickness. In this way, less energy is needed for welding during the laser welding as compared to a welding with no reduced material thickness. Furthermore, a welding device can be used with lower power as compared to the edge region not reduced in thickness, which is economically advantageous.

The reduced material thickness of preferably around 0.4 millimeters is realized preferably during the roll forming prior to the welding process by in each case a one-sided rolling pressure effect, for example. The segments to be welded together, for example, along a length line of the hollow profile, preferably have a material thickness reduced by 40 to 60 percent as compared to the material thickness of the remaining regions of the shaped flat or strip material, e.g., 0.8 millimeters or more. In the case of oppositely situated edges of the shaped flat or band material to be welded together, both edges have a reduced material thickness, preferably the identical reduced material thickness of around 0.4 millimeters. The width at the end of the material edge to be welded together by which the material thickness is reduced is in the millimeter range.

If the guide rail according to the present invention is made of a plastic material, an extrusion process is advantageous for the manufacturing.

The present invention also includes a furniture or household appliance, especially a kitchen appliance, comprising a body and a push element, wherein the push element is received movably on the body with a guidance system, wherein a guidance system according to the present invention for the push element is present according to one of the embodiments discussed above. In this way, the advantages explained can be achieved for the furniture or household appliance.

BRIEF DESCRIPTION OF THE DRAWINGS

Further features and advantages of the present invention are explained more closely with the aid of the exemplary embodiments of the present invention as represented in the figures. Specifically, there are shown.

DETAILED DESCRIPTION OF THE INVENTION

In part, the same reference numbers are used below for corresponding elements of different exemplary embodiments.

Figure 1:
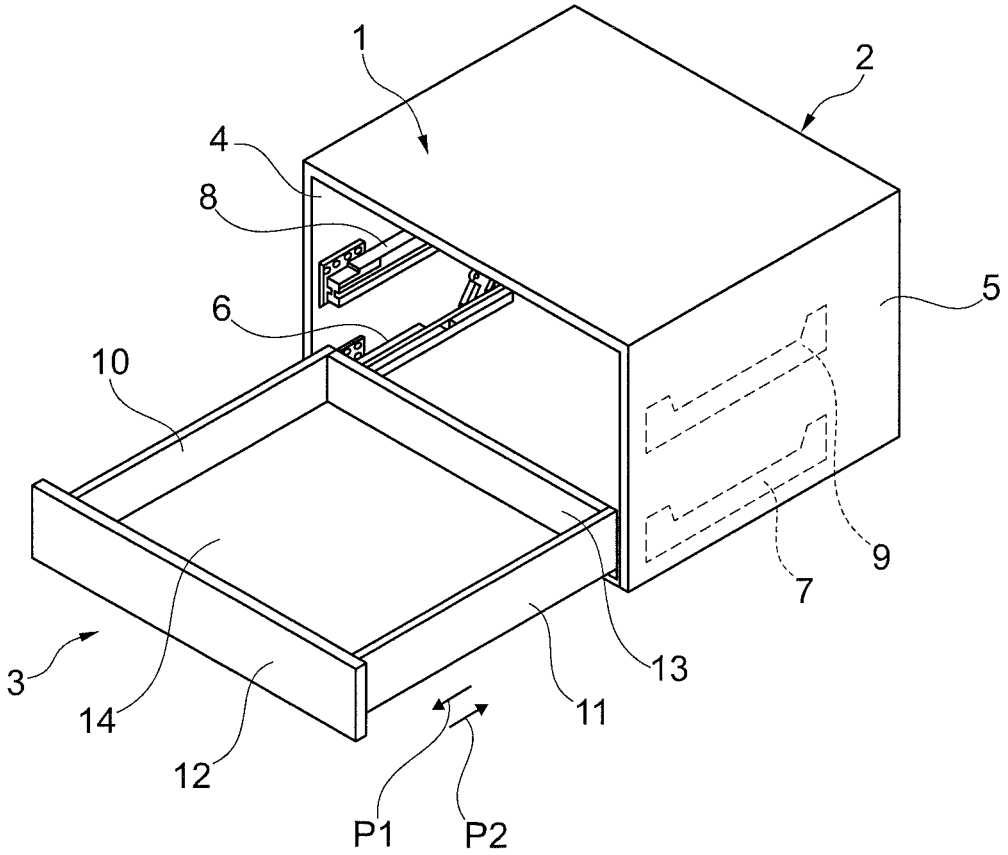
FIG. 1 is a schematically represented piece of furniture according to the present invention in perspective view slanting from above with a drawer displaceably received on it.

FIG. 1 shows highly schematized a piece of furniture 1 according to the present invention in a condition of use with a hollow cuboidal furniture body 2 and a push element fashioned as a drawer 3, wherein the drawer 3 is received displaceably on the furniture body 2. The furniture body 2 comprises two opposite vertical side walls 4 and 5, between which the drawer 3 can be pulled out in the horizontal direction from the furniture body 2 per P1 from a condition accommodated in the interior of the furniture body 2 via a guidance system according to the present invention with telescoping guiding means or a first rail full extension 6 and a second rail full extension 7 and pushed into the body in the opposite direction per P2. In FIG. 1, the drawer 3 is shown in the condition moved out to the utmost or entirely from the interior of the furniture body 2. Hence, the storage volume of the drawer 3 is accessible from above with almost no hindrance.

If the drawer 3 uses a rail partial extension instead of the rail full extensions 6, 7, the drawer 3 in the maximum pulled-out condition cannot be moved so far out from the interior of the furniture body 2 in the direction P1, as is possible with the rail full extensions 6, 7 per the representation in FIG. 1. The front element 12 is then closer to the open front side of the furniture body 2 than is shown in the drawer 3 of FIG. 1.

The rail full extension 6 screwed to the side wall 4 on the inside is located opposite at the same vertical height as the rail full extension 7 screwed to the side wall 5 and hidden from view in FIG. 1, being indicated by broken lines.

Further drawers correspondingly guided by rail full extensions 8 and 9 can be accommodated in the furniture body 2 above the drawer 3, not being shown in FIG. 1.

The drawer 3 comprises oppositely situated drawer side walls 10, 11, each comprising a constructed hollow chamber frame. Furthermore, the drawer 3 comprises a front element 12, a rear wall 13 situated opposite to it in the horizontal direction, and a horizontally extending drawer bottom 14, which reaches as far as the drawer side walls 10, 11, the front element 12 and the rear wall 13 or is joined to them.

Figure 2:
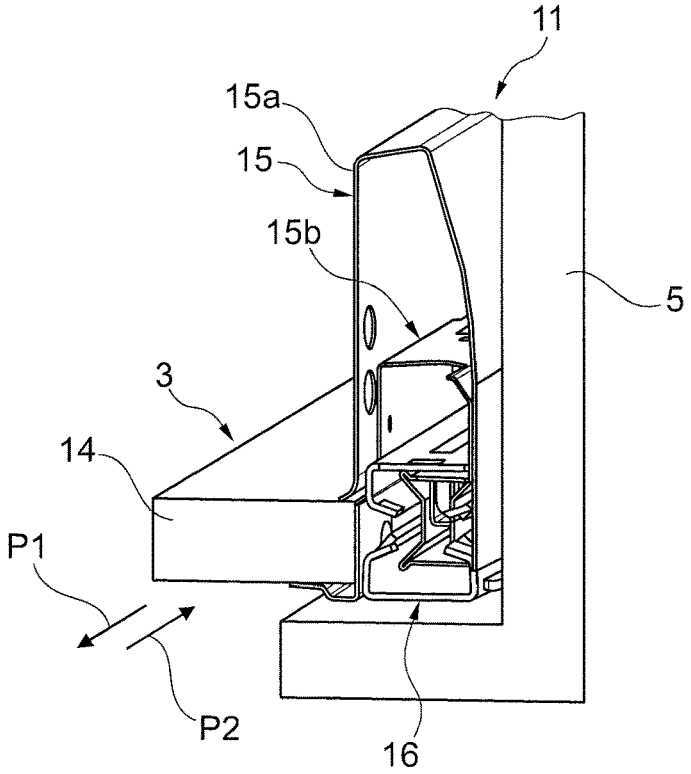
FIG. 2 is in cross section, a perspective cutout view of a piece of furniture according to the present invention in the region of a drawer side, adjacent to a furniture body wall and a furniture body bottom.
Figure 3:
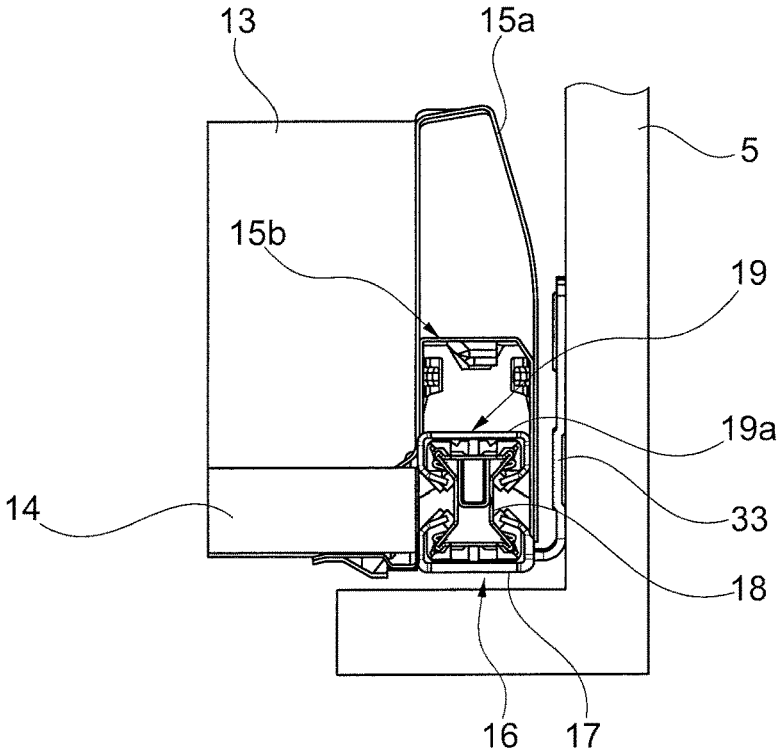
FIG. 3 is the cutout of FIG. 2 in a front view.

FIGS. 2 and 3 show, in the area of a body side wall 5, a cut-out of a drawer 3 with a drawer bottom 14 and a drawer side wall 11 and a rear wall 13 configured as a hollow chamber frame 15. The drawer 3 is received by two structural units of a guidance system according to the present invention on the furniture body 2 or by a rail full extension 16 according to the present invention on the side wall 5 and in the same manner by a further hollow chamber frame of the drawer 3 on the side wall 4 not visible in FIG. 2. It is received on the side wall 4 by a further structural unit or a further full extension according to the present invention, by which the drawer 3 can move in linear horizontal manner in the directions P1 and P2.

The hollow chamber frame 15 made preferably from a bent sheet metal material has an external housing 15*a* and an internal structure 15*b*, so that the full extension 16 can be recessed into the internal volume of the hollow chamber frame 15. At an inner side of the hollow chamber frame 15, it is configured to receive a lengthwise edge of the drawer bottom 14 in its lower segment.

The full extension 16 according to the present invention formed as a structural unit of the guidance system comprises three mutually telescopic guide rails or a body rail 17, a center rail 18 and a push element rail 19.

The center rail 18 is configured as a hollow profile according to the present invention.

Figure 4:
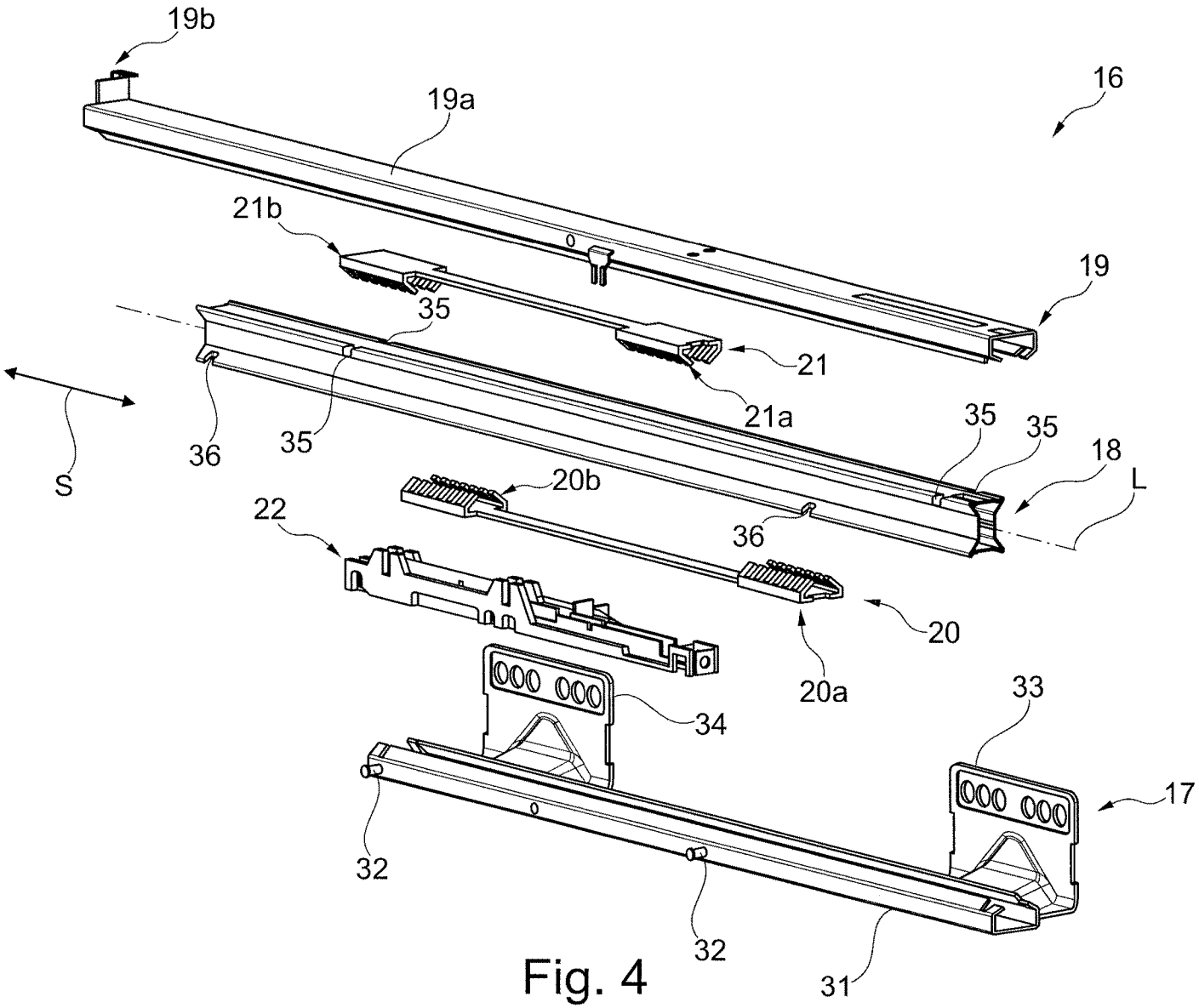
FIG. 4 is an exploded view of a structural unit of a guidance system according to the present invention.

A push element to be moved such as the drawer 3 is coupled or connected to the push element rail 19, for example, it is secured to the hollow chamber frame 15, whereas the body rail is connected to the stationary part of the furniture. If the full extension 16 is being used as a subfloor guide, a bottom side of a push element or its bottom will be braced against a top side 19*a* of the push element rail 19. A hook element 19*b* protruding upward at the rear end of the push element rail 19 forms an end stop for a segment of a rear outer side of the push element, wherein for the exact positioning an angled segment of the hook element 19*b* parallel to the top side 19*a* engages with a suitably provided recess in the rear outer side of the push element. In this way, the rear region of the full extension 16 in the condition of use is also established in FIG. 4, on the left side in FIG. 4, and a front region of the full extension 16 in the condition of use is established on the right side in FIG. 4.

Furthermore, the full extension 16 comprises a first or lower carriage 20 with bearing bodies arranged on it, the carriage 20 acting between the body rail 17 and the center rail 18 for a load-transmitting relative movement of the rails 17, 18.

Moreover, the full extension 16 comprises a second or upper carriage 21 with bearing bodies arranged on it, the carriage 21 acting between the center rail 18 and the push element rail 19 for a load-transmitting relative movement of the rails 18, 19.

Pins 32 are present on a vertically positioned, inwardly pointing narrow side of a rail body 31 of the body rail 17, by which a movement mechanism 22 of the full extension 16 can be attached, for example, for the ejecting and/or retracting of the drawer 3.

The body rail 17 includes two L-shaped fastening elements 33 and 34, the fastening elements 33 and 34 serving for the fastening or securing of the full extension to an inner side of the side wall of a body, such as the side wall 5 of the furniture body 2 of the furniture 1.

The guide rails 17, 18, 19 preferably consist of a sheet metal material, which is formed into the end product of the respective guide rail from the flat sheet metal material, for example, by a stamping and bending process.

Figure 5:
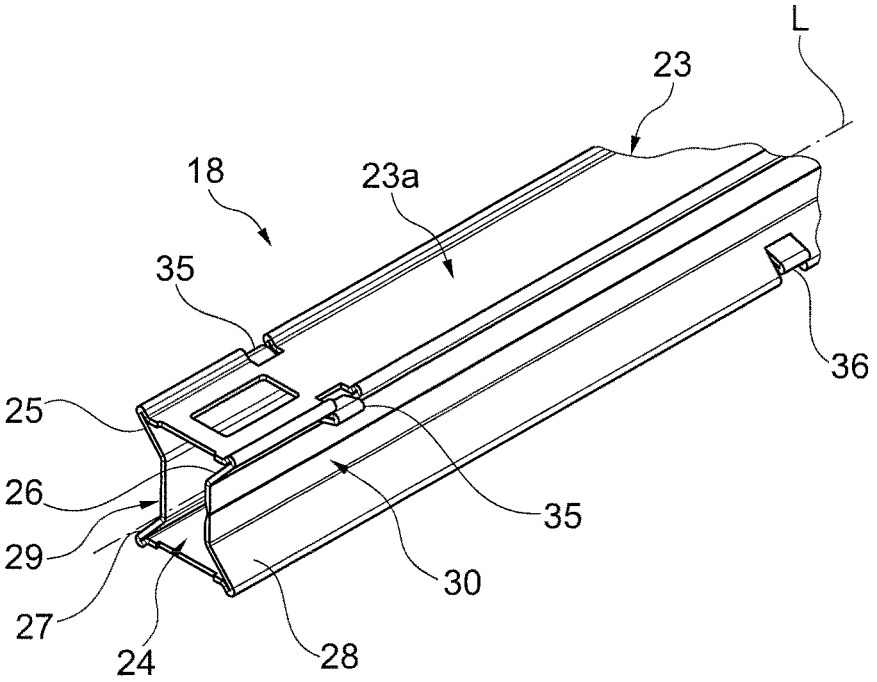
FIG. 5 is a perspective representation of an end segment of a center rail of the guidance system of FIG. 4, FIG. 6 a front view of the center rail of FIG. 5.

FIG. 5 shows the front end segment of the center rail 18 with respect to the condition of use of the full extension 16. The center rail 18 according to the exemplary embodiment shown comprises an upper flat horizontal wall section 23, a lower flat horizontal wall section 24, two flat upper side wall sections 25, 26, two lower flat side wall sections 27, 28 and intermediate sections 29 and 30.

The horizontal wall section 23 forms a distal wall or top side of the center rail 18 or the corresponding hollow profile. Accordingly, the horizontal wall section 24 forms a distal wall or bottom side of the center rail 18 or the hollow profile.

The terms upper and lower pertain to the orientation of the full extension 16 in the condition of use or in the condition mounted on the furniture, especially as shown in FIGS. 2 and 3. The planes respectively subtended by the mutually parallel horizontal wall sections 23 and 24 and their exterior or distal sides are at least almost horizontally oriented.

Figure 6:
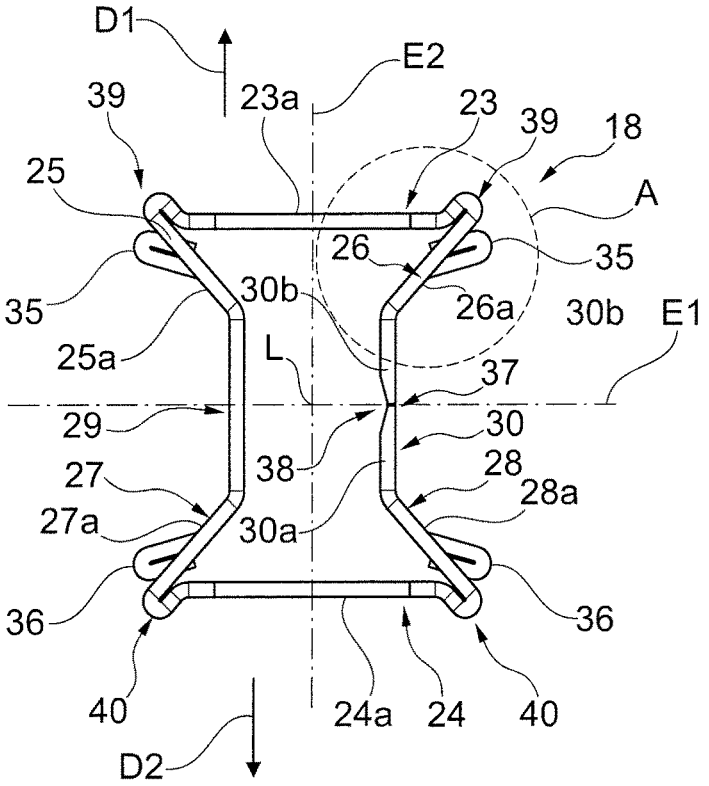

The center rail 18 or the center rail hollow profile is advantageously fashioned in mirror symmetry to the mutually perpendicular planes E1 and E2 (see FIG. 6).

In FIG. 6, two directions D1 upward and D2 downward are specified parallel to plane E2, indicating a distal direction along a height direction of the center rail 18 in its condition of use or a direction pointing away from the center along the longitudinal axis L. Distal directions likewise exist along the plane E1, running along a width direction of the center rail 18.

In order to limit a relative movement of the lower carriage 20 and the upper carriage 21 with respect to the center rail 18 in the lengthwise extension of the center rail 18 along a central longitudinal axis L (see FIG. 5), upper end stops 35 and lower end stops 36 are provided on the center rail 18.

In the assembled full extension 16, the bearing bodies received on the carriages 20, 21 run on the outwardly directed sides of the center rail 18 or on the horizontal wall sections 23, 24 and the side wall sections 25-28. The lower carriage 20 engages by its segments 20*a* and 20*b* carrying the bearing bodies on the outside of the horizontal wall section 24 and the side wall sections 27, 28.

The upper carriage 21 engages by its segments 21*a* and 21*b* carrying the bearing bodies on the outside of the horizontal wall section 23 and the side wall sections 25, 26.

Accordingly, the respective corresponding bearing bodies of the lower carriage 20 roll on the distal side or the outer side 24*a* of the lower horizontal wall section 24, on the outer side 27*a* of the side wall section 27 and on the outer side 28*a* of the side wall section 28.

The respective corresponding bearing bodies of the upper carriage 21 roll on the distal side or the outer side 23*a* of the upper horizontal wall section 23, on the outer side 25*a* of the side wall section 25 and on the outer side 26*a* of the side wall section 26.

The bearing bodies of the carriage 20, 21 are preferably outwardly cylindrical bearing bodies or roller bearing bodies such as bearing rollers or bearing needles.

The center rail 18 formed from an originally flat and level metal sheet is formed as a hollow profile and has a material bond or a welded connection or narrow weld seam 37 over its length along the longitudinal axis L. The weld seam 37 produced preferably with a continuous laser method joins narrow, blunt abutting sides of a lower part region 30*a* and an upper part region 30*b* of the intermediate section 30.

For an advantageously to be produced material bond of the part regions 30*a* and 30*b*, their mutually facing edges 38 or the edges 38 of the blunt abutting sides are reduced in the material thickness or in the material strength with respect to the material thickness or the sheet metal thickness s (see FIG. 7) of the remaining material of the center rail 18 and lie, for example, in the range of half the material thickness (see FIG. 6) as compared to the sheet metal thickness s possessed uniformly by the remaining material regions.

Each time a uniform connection section 39 is formed between a first lengthwise edge of the upper horizontal wall section 23 and the side wall section 25 and between a second lengthwise edge of the upper horizontal wall section 23 and the side wall section 26.

In corresponding fashion, each time a uniform connection section 40 is formed between a first lengthwise edge of the lower horizontal wall section 24 and the side wall section 27 and between a second lengthwise edge of the lower horizontal wall section 24 and the side wall section 28.

Preferably or especially for a mirror symmetry about two perpendicular planes E1, E2, all four connection sections 39 and 40 are fashioned identically.

Figure 7:
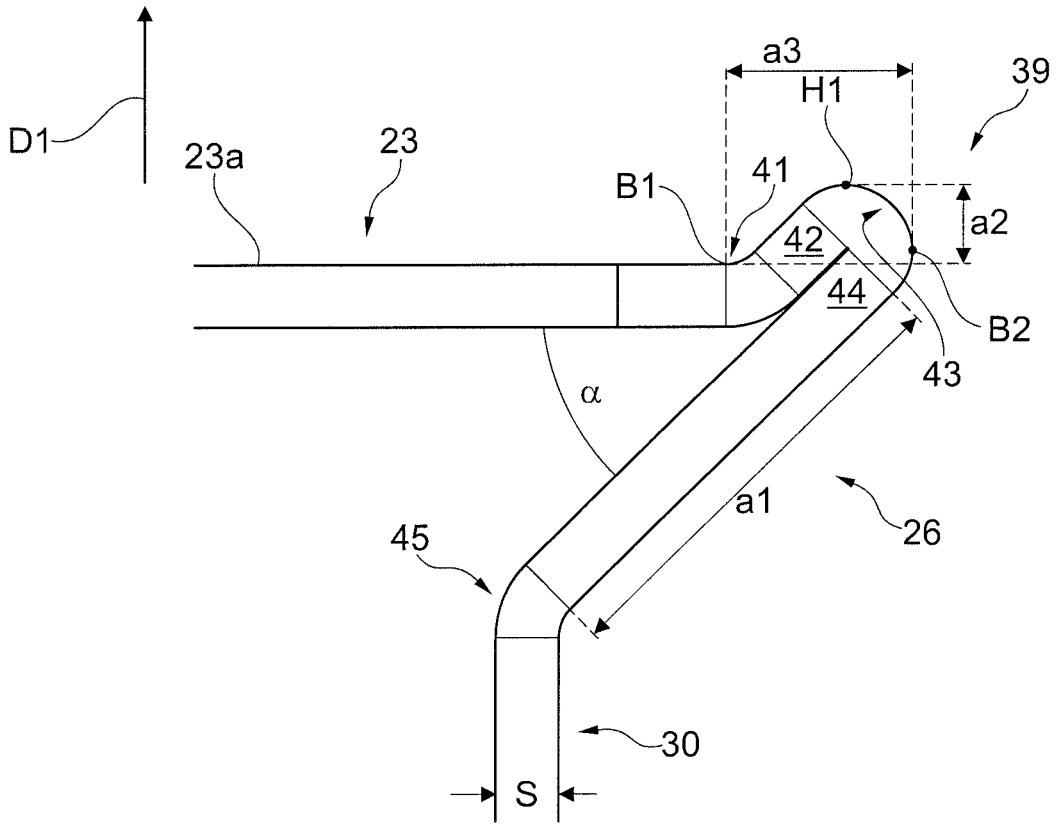
FIG. 7 the encircled region A in FIG. 6 in enlarged detail view without an end stop 35.

For a better representation, the end stop 35 is left out in FIG. 7.

The connection sections 39, 40 are formed by a forming or bending process and extend over the entire length of the center rail 18. The connection sections 39, 40 are loop shaped in the cross section per FIGS. 6 and 7. The connection sections 39 protrude partly beyond the distal side or beyond the top side of the center rail 18 formed by the horizontal wall section 23. The connection sections 40 also protrude partly beyond the distal side or beyond the bottom side of the center rail 18 formed by the horizontal wall section 24.

With the connection sections 39, 40, on the one hand, advantageously a connection of mutually angled flat segments of the center rail 18, i.e., a horizontal wall section 23, 24 and an adjoining side wall section 25-27, made from a continuous originally flat sheet metal segment, is advantageously achieved, and on the other hand a highly mechanically stable hollow profile is provided. In particular, the center rail 18 has a relatively large bending rigidity to bending along the longitudinal axis L and an elevated stability to twisting or to torsion about the longitudinal axis L.

On the whole, this helps provide a reinforcing of the center rail 18 as compared to a connection of a horizontal wall section to a side wall section by a simple bend between the horizontal wall section and the side wall section.

The configuration and stabilization is furthermore enabled in a compact or space-saving and material-saving manner.

The preferably identical connection sections 39, 40 shall be explained below with the specific connection section 39 shown in FIG. 7.

As becomes especially clear in detail from the front view of FIG. 7, an outwardly directed flat bend section 42 adjoins the upper horizontal wall section 23 or sideways on the outside along the length of the horizontal wall section 23 across a first bend 41 at a location B1. A further bend 43, opposite the bend 41 by 180 angular degrees, adjoins the bend section 42 and passes into a support section 44. The support section 44 is adjacent and parallel to the bend section 42. The support section 44 is extended with no further bend into the upper side wall section 26 or the support section 44 represents an extension of the side wall section 26. The flat side wall section 26 extends across the segment width a1 downward at a slant to a further bend 45, which passes into the intermediate section 30 with the vertical or perpendicular wall section.

Advantageously, one inner side of the bend section 42 is in bearing contact with an inner side of the support section 44 for most of its extension.

For the upper bearing bodies of the upper carriage 21, which roll on the outer side 23*a* of the horizontal wall section 23 during a displacement movement of the rails 18 and 19, the upwardly bent bend section 42 can act as a side boundary, along the length of the center rail 18 between the front end stops 35 and the rear end stops 35.

On the other lengthwise side of the horizontal wall section 23, the corresponding bend section of the other connection section 39 acts in corresponding fashion as a further side boundary of the upper bearing bodies of the carriage 21.

In the height direction, an elevation a2 is produced on the hollow profile with the connection section 39 from the top side 23*a* of the horizontal wall section 23 to a highest point H1 in the area outside of the bend 43. The values a2 and a3 may also be less than or equal to zero.

In the width direction or transversely to the height direction, a broadening a3 is produced on the hollow profile with the connection section 39 from the point B1 on the lengthwise edge of the horizontally oriented top side 23*a* of the horizontal wall section 23 to a maximum outwardly situated point B2 in the area outside of the bend 43.

An internal angle $\alpha$ between the plane along the inner side of the horizontal wall section 23 and the plane along the inner side of the side wall section 26 is preferably between 20 and 70 angular degrees, preferably between 35 and 55 angular degrees, preferably around 45 angular degrees, which is realized for the center rail 18.

Basically, for the same configuration of the connection section 39, the side wall section 26 per FIG. 7 can form a horizontal wall section of an alternative center rail according to the present invention and the horizontal wall section 23 per FIG. 7 can form a side wall section of the alternative center rail.

In other words, the cut-out per FIG. 7 can be rotated counterclockwise until the side wall section 26 is oriented horizontally and forms the horizontal wall section of the alternative center rail. The connection section 39 then constitutes the transition from the alternative horizontal wall section to the alternative side wall section. Thus, on the alternative horizontal wall section, there is no protrusion beyond its top side.

Thus, neither is there any side boundary function for the bearing bodies of the upper carriage 21, which roll on the outer side of the horizontal wall section.

However, then the bend section 42 forms a side upper boundary for the bearing bodies of the upper carriage 21, which roll on the outer side of the alternative side wall section.

Other departures from the full extension 16 shown in FIGS. 2 to 7, especially from the configuration of the center rail and especially the connection section 39 and 40, likewise lie within the present invention and result in alternative advantageous center rails according to the invention.

For example, according to an alternative advantageous embodiment of the present invention, the bearing contact between the inner side of the bend section 42 and the inner side of the support section 44 is entirely or partially eliminated, so that a preferably smaller distance or air gap results in the millimeter range between the inner side of the bend section 42 and the inner side of the support section 44.

LIST OF REFERENCE NUMBERS

1 Furniture
2 Furniture body
3 Drawer
4 Side wall
5 Side wall
6 Rail full extension
7 Rail full extension
8 Rail full extension
9 Rail full extension
10 Drawer side wall
11 Drawer side wall
12 Front element

13 Rear wall
14 Drawer bottom
15 Hollow chamber frame
15*a* Housing
15*b* Internal structure
16 Full extension
17 Body rail
18 Center rail
19 Push element rail
19*a* Top side
19*b* Hook element
20 Carriage
20*a* Segment
20*b* Segment
21 Carriage
21*a* Segment
21*b* Segment
22 Movement mechanism
23 Horizontal wall section
23*a* Outer side
24 Horizontal wall section
24*a* Outer side
25 Side wall section
25*a* Outer side
26 Side wall section
26*a* Outer side
27 Side wall section
27*a* Outer side
28 Side wall section
28*a* Outer side
29 Intermediate section
30 Intermediate section
30*a* Part region
30*b* Part region
31 Rail body
32 Pin
33 Fastening element
34 Fastening element
35 End stop
36 End stop
37 Weld seam
38 Edge
39 Connection section
40 Connection section
41 Bend
42 Bend section
43 Bend
44 Support section
45 Bend

The invention claimed is:

1. A guide rail for a guidance system for a push element of furniture or a household appliance, the guide rail comprising:

a hollow profile enclosed by wall sections, the wall sections comprising horizontal wall sections and two side wall sections, wherein the horizontal wall sections extend parallel and perpendicular to a lengthwise extension of the guide rail, and the side wall sections extend parallel and perpendicular to the lengthwise extension of the guide rail, wherein the side wall sections are oriented at an angle with respect to the horizontal wall sections, wherein the horizontal wall sections and the two side wall sections, in a cross section perpendicular to a lengthwise extension of the guide rail, form at least a portion of three side lines of a triangle, wherein the horizontal wall sections define distal walls of the hollow profile, and wherein at least one of the horizontal wall sections comprises a weld seam, and wherein a material thickness of the horizontal wall section proximate the weld seam is thinner than a material thickness of remaining portions of the horizontal wall sections.

2. The guide rail according to claim 1, wherein the wall sections further comprise a connection section, wherein the horizontal wall sections and the side wall sections are joined across the connection section, wherein the connection section comprises a support section and a bend section that is angled on the support section, in and wherein the bend section is angled toward the support section so that the bend section and the support section subtend a bend angle in a range between 45 angular degrees and 180 angular degrees.

3. The guide rail according to claim 2, wherein the one side of the bend section of the connection section bears against the support section.

4. The guide rail according to claim 2, wherein the support section is oriented parallel to one of the side wall sections.

5. The guide rail according to claim 2, wherein the bend section is oriented parallel to one of the side wall sections parallel to a support section.

6. The guide rail according to claim 2, wherein the hollow profile comprises an end stop element acting in a lengthwise direction of the hollow profile in the region of the connection section.

7. The guide rail according to claim 2, wherein the bend section of the connection section is bent in a curve.

8. The guide rail according to claim 1, wherein the horizontal wall sections form at least one of a top side and a bottom side of the hollow profile.

9. The guide rail according to claim 1, wherein the guide rail is formed from a formed flat material.

10. The guide rail according to claim 1, wherein the hollow profile is present in mirror symmetry in two mirror planes in a cross section, and wherein the two mirror planes stand perpendicular to each other.

11. The guide rail according to claim 1, wherein the wall sections comprise a vertical wall section, and wherein the vertical wall section joins the side wall sections to each other.

12. The guide rail according to claim 1, wherein at least one of the horizontal wall sections and the side wall sections define a contact surface for portions of a bearing assembly for at least a part of a length of the guide rail.

13. A linear guidance system for a push element of furniture or a household appliance, the linear guidance system comprising:

a structural unit with precisely two guide rails, wherein the guide rails comprise a body rail comprising the guide rail of claim 1 and a push element rail movably received on the body rail, wherein the push element rail is adapted to connect to a push element; and wherein a carriage is provided between segments of the body rail and the push element rail to effect a relative movement between body rail and push element rail.

14. A linear guidance system for a push element of furniture or a household appliance, the linear guidance system comprising:

a structural unit with precisely three guide rails, the guide rails comprising a body rail, a push element rail and a center rail, wherein the center rail comprises the guide rail of claim 1;

wherein the push element rail is adapted to connect to a push element, wherein the center rail is present between the body rail and the push element rail; and wherein a carriage is provided between segments of the body rail and the center rail, and a carriage is provided between segments of the center rail and the push element rail to effect a relative movement between the rails.

15. A furniture or household appliance comprising a body and a push element, wherein the push element is movably received on the body with a guidance system comprising a push element and a guide rail according to claim 1.

16. The furniture or household appliance of claim 15, wherein the furniture or household appliance is a kitchen appliance.

17. A method for manufacturing a guide rail, wherein the guide rail comprises:

a hollow profile enclosed by sections, the wall sections comprising horizontal wall sections and two side wall sections, wherein the horizontal wall sections extend parallel and perpendicular to a lengthwise extension of the guide rail, and the side wall sections extend parallel and perpendicular to the lengthwise extension of the guide rail, wherein the side wall sections are oriented at an angle with respect to the horizontal wall sections, wherein the horizontal wall sections and the two side wall sections, in a cross section perpendicular to a lengthwise extension of the guide rail, form at least a portion of three side lines of a triangle, wherein the horizontal wall sections define distal walls of the hollow profile; and wherein the method comprises:

fabricating the guide rail from a flat material, by a continuous forming process step to form a formed flat material; and comprising a work step comprising a continuous laser welding step of welding a connection between segments of the formed flat material following the continuous forming process step;

wherein a material thickness in a region of the welded connection of the formed flat material is reduced compared to remaining regions of the formed flat material.

18. The method according to claim 17, wherein the continuous forming process is a continuous roll forming process.

19. The method according to claim 17, where the formed flat material is a strip material.

20. A guide rail for a guidance system for a push element of furniture or a household appliance, the guide rail comprising:

a hollow profile enclosed by wall sections, the wall sections comprising horizontal wall sections and two side wall sections, wherein the horizontal wall sections extend parallel and perpendicular to a lengthwise extension of the guide rail, and the side wall sections extend parallel and perpendicular to the lengthwise extension of the guide rail, wherein the side wall sections are oriented at an angle with respect to the horizontal wall sections, wherein the horizontal wall sections and the two side wall sections, in a cross section perpendicular to a lengthwise extension of the guide rail, form at least a portion of three side lines of a triangle, wherein the horizontal wall sections define distal walls of the hollow profile, and wherein the wall sections further comprise bent connection sections that protrude outwardly at least partially beyond a plane of the respective horizontal wall sections, and wherein a cross-sectional shape of the bent connection sections is a loop.

* * * * *